US012698015B2

(12) United States Patent
Scottini et al.

(10) Patent No.: US 12,698,015 B2
(45) Date of Patent: Aug. 4, 2026

(54) DEVICE FOR COOLING A COMPONENT INTENDED TO BE FITTED TO A VEHICLE AND ASSOCIATED VEHICLE

(71) Applicant: ALSTOM Holdings, St Ouen sur Seine (FR)

(72) Inventors: Jonathan Scottini, Anderlecht (BE); Ludovic Rucquoy, Gosselies (BE); Yan Cheng, Hoeilaart (BE)

(73) Assignee: ALSTOM HOLDINGS, Saint-Ouen-sur-Seine (FR)

( * ) Notice: Subject to any disclaimer, the term of this patent is extended or adjusted under 35 U.S.C. 154(b) by 901 days.

(21) Appl. No.: 18/050,435

(22) Filed: Oct. 27, 2022

(65) Prior Publication Data

US 2023/0139958 A1 May 4, 2023

(30) Foreign Application Priority Data

Nov. 2, 2021 (FR) ..... 21 11611

(51) Int. Cl.
*B61D 27/00* (2006.01)

(52) U.S. Cl.
CPC ..... *B61D 27/009* (2013.01)

(58) Field of Classification Search
CPC ..... B61D 27/009; H05K 7/2089
See application file for complete search history.

(56) References Cited

U.S. PATENT DOCUMENTS

| | | | |
|---|---|---|---|
| 2015/0158504 | A1 | 6/2015 | Do et al. |
| 2016/0143193 | A1 | 5/2016 | Ono et al. |
| 2017/0303430 | A1 | 10/2017 | Enami et al. |

FOREIGN PATENT DOCUMENTS

| | | | |
|---|---|---|---|
| DE | 1964939 | A1 | 7/1971 |
| DE | 101 18 219 | A1 | 10/2002 |
| EP | 0578549 | A1 | 1/1994 |
| EP | 2078655 | A1 | 7/2009 |
| JP | 2012-210914 | A | 11/2012 |
| WO | 2019/086441 | A1 | 5/2019 |

OTHER PUBLICATIONS

French Search Report issued for French Patent Application No. 2111611, dated Jun. 9, 2022 in 2 pages.

*Primary Examiner* — Allen R. B. Schult
(74) *Attorney, Agent, or Firm* — Knobbe, Martens, Olson & Bear, LLP

(57) ABSTRACT

The invention relates to a device for cooling a component for use in a vehicle. Said component comprises a first side face and a second side face opposite each other and cooling channels running between the first side face and the second side face. The cooling device comprises a first opening, a second opening and a set of baffles configured such that movement of the vehicle generates an airflow entering one of the first opening and the second opening and exiting the other, the set of baffles being configured to guide the airflow through the cooling channels of the component.

12 Claims, 3 Drawing Sheets

DEVICE FOR COOLING A COMPONENT INTENDED TO BE FITTED TO A VEHICLE AND ASSOCIATED VEHICLE

CROSS-REFERENCE TO RELATED APPLICATION

This application claims priority to French Patent Application No. 21 11611 filed on Nov. 2, 2021, the disclosure of which including the specification, the drawings, and the claims is hereby incorporated by reference in its entirety.

TECHNICAL FIELD

This invention relates to a device for cooling a component intended to be fitted to a vehicle, in particular a railway vehicle.

BACKGROUND

In order to free up space in the vehicle interior, components, such as wound components, are usually attached to the outside of the vehicle body, particularly under the body or on the roof of the vehicle.

Wound components are likely to generate heat during operation, particularly through Joule heat loss, and must be cooled to avoid overheating.

Such components are usually cooled by natural ventilation, without channeling an air flow.

The disadvantage of this type of cooling, however, is that it requires a large amount of space under the vehicle body or roof to allow a sufficiently large quantity of air to circulate around the component to cool it.

However, the space available under the body or roof of the vehicle, particularly due to the proximity of the various components to each other, is generally limited and may not allow sufficient airflow around each component.

In addition, the air turbulence caused by the movement of the vehicle disturbs the air flow, making such cooling unreliable.

It is also known to cool such components by means of a forced cooling device, for example by means of a fan or a heat pump circuit.

However, due to its energy consumption, such a cooling system is inefficient and increases the energy impact of the vehicle.

In addition, such a cooling device requires additional maintenance to ensure its operation and is generally noisy.

SUMMARY OF THE INVENTION

One of the aims of the invention is to provide a device for cooling such a component that is economical, low energy and low volume, while allowing reliable cooling of the component.

Thus, the invention relates to a device for cooling a component intended to be fitted to a vehicle, in particular a railway vehicle, intended to move in a longitudinal direction, said component comprising a first side face and a second side face opposite to each other and cooling channels running through the component between the first side face and the second side face, the cooling device comprising a first opening, a second opening and a set of baffles configured such that movement of the vehicle in the longitudinal direction generates a flow of air into one of the first opening and the second opening and out of the other, the set of baffles being configured to guide the flow of air through the cooling channels of the component.

The use of the airflow generated by the vehicle's movement allows passive cooling of the component without energy consumption.

In addition, guiding the air flow through the set of baffles through the component's cooling channels allows the component to be cooled efficiently, regardless of the direction of travel of the vehicle.

According to particular embodiments of the invention, the device comprises one or more of the following features taken in isolation or in any combination that is technically possible:

- the first opening and the second opening are arranged laterally on the same side of the component;
- the baffle assembly is configured to guide the airflow through the component transversely in a first transverse direction through a first group of cooling channels and then in a second opposite transverse direction through a second group of cooling channels or vice versa;
- the baffle assembly comprises an intermediate baffle arranged on one of the first side face and the second side face of the component to guide the air flow exiting from the cooling channels of the first group to the channels of the second group or vice versa;
- the cooling device comprises an inner baffle arranged within the component to prevent a flow of air longitudinally through the component;
- the inner baffle extends between the first side face and the second side face of the component and divides the component into a first region and a second region;
- at least one cooling channel is arranged in the first region and at least one cooling channel is arranged in the second region;
- the cooling device comprises a first grille across the first opening and/or a second grille across the second opening;
- the cooling device is configured such that when the vehicle moves in a first direction, the airflow flows from the first opening to the second opening, and when the vehicle moves in a second direction opposite to the first direction, the airflow flows from the second opening to the first opening.

The invention also relates to a vehicle, in particular a railway vehicle, intended to travel in a longitudinal direction, the vehicle comprising a component comprising a first side face and a second side face opposite each other and cooling channels passing through the component extending between the first side face and the second side face, and a device for cooling said component as described above.

BRIEF DESCRIPTION OF THE DRAWINGS

The invention will be better understood upon reading the following description, given only as an example, and with reference to the attached drawings, in which.

DETAILED DESCRIPTION OF PREFERRED EMBODIMENTS

Figure 1:
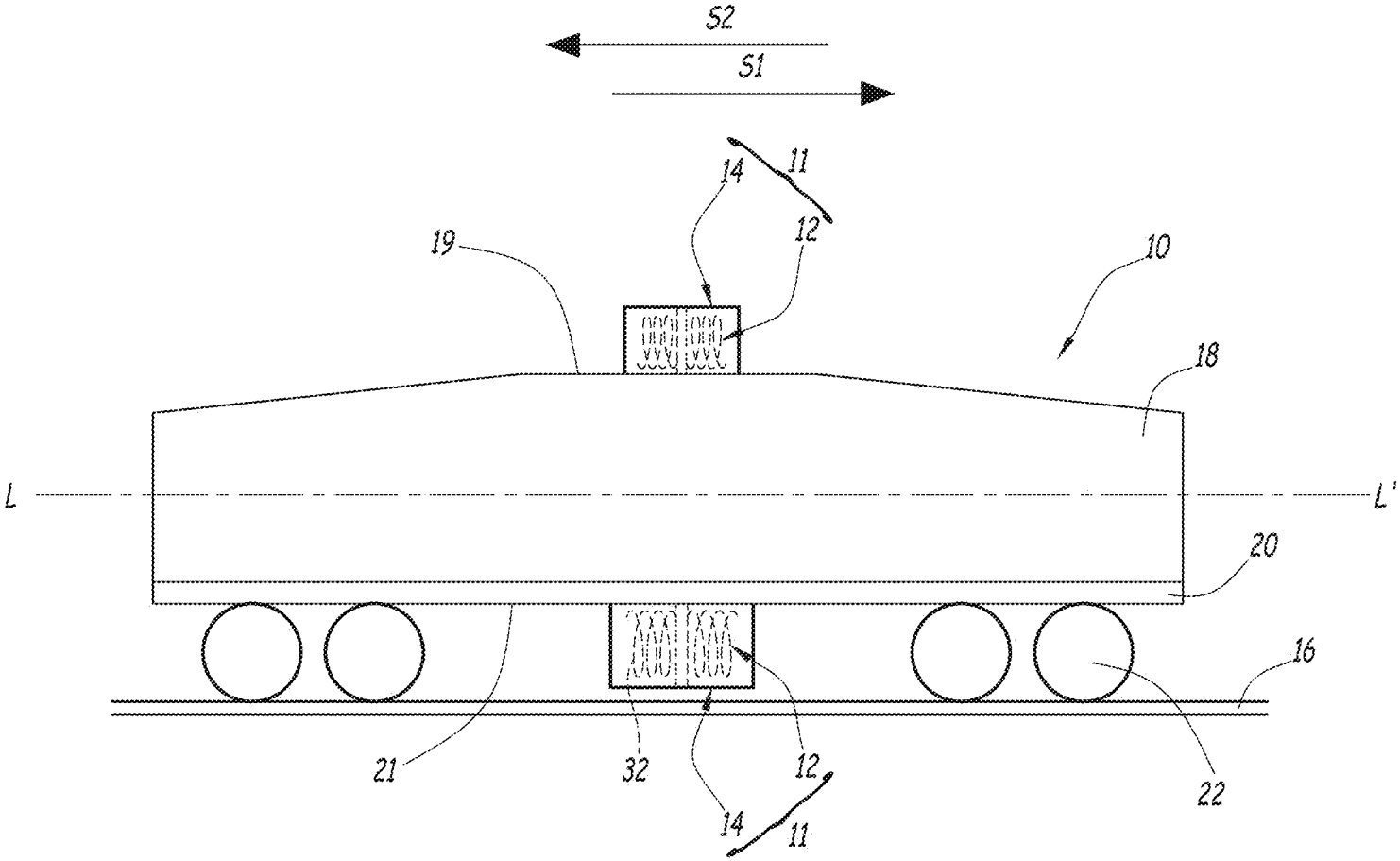
FIG. 1 is a side view of a vehicle comprising a device for cooling a component according to the invention under the vehicle body and a device for cooling a component according to the invention on the vehicle roof.

FIG. 1 shows a vehicle 10 with modules 11, each module 11 comprising a component 12 and a cooling device 14 for said component 12.

The vehicle 10 is for example a railway vehicle or a road vehicle, such as a bus.

The vehicle 10 is intended to move along a longitudinal direction L-L' in a first direction S1 and/or in a second direction S2 opposite to the first direction S1. The first direction S1 corresponds, for example, to a forward movement of the vehicle 10, the second direction S2 corresponds to a rearward movement.

In case the vehicle 10 is a railway vehicle as shown in FIG. 1, the longitudinal direction L-L' corresponds to the direction of rails 16 of a railway track on which the railway vehicle 10 runs.

In all that follows, the orientations are the usual orientations of a vehicle. Thus, the terms "front", "rear", "left", "right", "top", "bottom", "longitudinal", "transverse" and "vertical" are understood to refer to the first direction S1 of forward movement of the vehicle 10.

The vehicle 10 comprises a body 18 defining a roof 19 and a lower body 20 and wheels 22 mounted under the lower body 20. The wheels 22 support the vehicle 10. In the case of a railway vehicle 10, the wheels 22 run on the rails 16.

The roof 19 is the upper part of the body 18.

The lower part of the body 18 is called the lower body 20.

Figure 2:
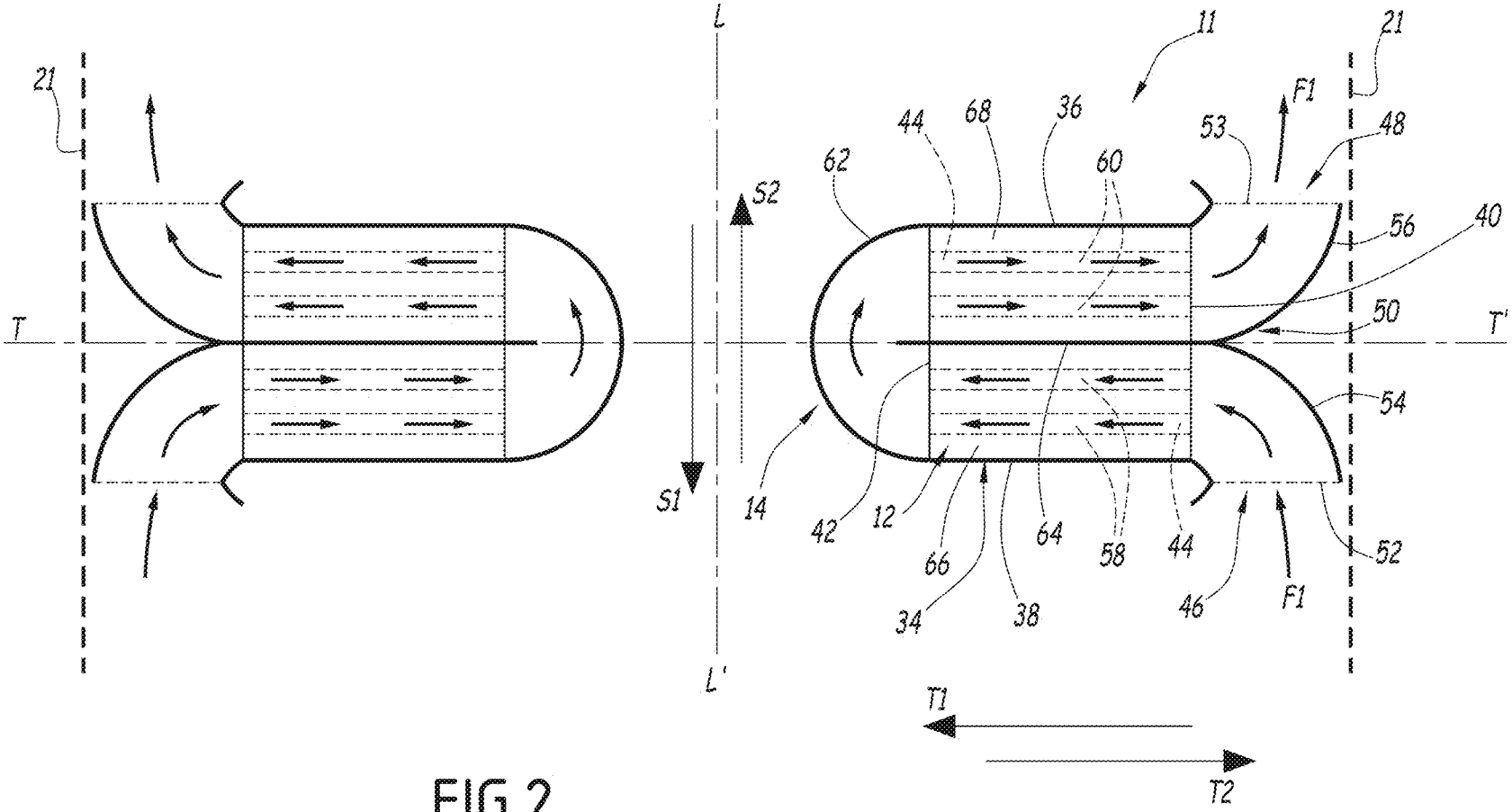
FIG. 2 is a bottom view of two cooling devices according to the invention, with the vehicle moving in a first forward direction.

As can be seen in FIG. 2, each of the roof 19 and the lower body 20 defines two longitudinal edges 21 opposite each other and corresponding, for example, to a right and a left edge of the lower body 20, respectively the roof 19.

Each module 11 is attached to the outside of the body 18 of the vehicle 10, and in particular under the lower body 20 or on the roof 19.

As shown in FIG. 2, the modules 11 are advantageously fixed in pairs either under the lower body 20 or on the roof 19 of the vehicle 10.

The two modules 11 of a pair are for example symmetrical with respect to a median longitudinal plane of the vehicle 10. The longitudinal median plane of the vehicle 10 is defined as the vertical plane passing through a line parallel to the longitudinal direction L-L' and dividing the vehicle 10 into a right part and a left part.

Each of the two modules 11 is arranged in the vicinity of a respective one of the two longitudinal edges 21 on the right or left side of the lower body 20 or the roof 19 respectively.

As the two modules 11 of the same pair are similar, only the module 11 on the right-hand side in FIG. 2 will be described in the following.

In operation, the component 12 generates heat, particularly when the vehicle 10 is in motion and moving in the longitudinal direction L-L'.

As illustrated in FIG. 1, the component 12 is for example a coiled component, i.e. a component comprising a coil 32.

During operation, such a component 12 generates heat losses by Joule effect.

The coil 32 is, for example, a dry-type inductor, in particular a coil using resin-based insulation.

Preferably, the component 12 generates heat loss only when the vehicle 10 is in motion. The component 12 does not generate heat loss when the vehicle 10 is stationary.

The component 12 is for example an element of the vehicle traction device 10, i.e. the device generating the traction force of the vehicle. Component 12 is for example a traction transformer.

Alternatively, component 12 is an electronic component, such as a resistor or a brake resistor assembly.

The component 12 is advantageously housed in a casing 34.

The casing 34 defines a rear face 36, a front face 38, a first side face 40 and a second side face 42 of the component 12.

The rear face 36 and the front face 38 of the component 12 extend substantially perpendicular to the longitudinal direction L-L'.

The first and second side faces 40, 42 of component 12 extend substantially parallel to the longitudinal direction L-L'.

The first side face 40 of the component 12 is located in the vicinity of one of the right or left longitudinal edges 21 of the lower body 20, respectively of the roof 19, and the second side face 42 of the component 12 is distant from said longitudinal edge 21, being transversely offset towards the middle of the body 18 with respect to the first side face 40.

The component 12 further comprises cooling channels 44 passing through the component 12 between the first side face 40 and the second side face 42.

Each cooling channel 44 defines a passageway allowing air to pass through the component 12 between the first side face 40 and the second side face 42, so as to cool said component 12.

As shown in FIG. 2, the cooling channels 44 are parallel to each other and extend in a transverse direction T-T' perpendicular to the longitudinal direction L-L'.

The cooling channels 44 are substantially parallel to the rear 36 and front 38 faces of the component 12.

The component 12 comprises at least two cooling channels 44 spaced apart from each other in the longitudinal direction L-L'.

The cooling device 14 of the component 12 comprises a first opening 46, a second opening 48 and a set of baffles 50.

The first and second openings 46, 48 are capable of allowing an air flow F1, F2 generated by the movement of the vehicle in the longitudinal direction L-L' to enter and leave the module 11.

The air flow F1, F2 is thus generated in a direction parallel to the longitudinal direction L-L' and is oriented relative to the vehicle 10 against the direction of travel of the vehicle 10.

For example, as shown in FIG. 2, when the vehicle is travelling in the first direction S1 towards the front of the vehicle 10, the airflow F1 is directed relative to the module 11 in the second direction S2.

When the vehicle is travelling in the first direction S1, the airflow F1 enters parallel to the longitudinal direction L-L' through the first opening 46 and exits through the second opening 48.

When the vehicle is travelling in the second direction S2, the air flow F2 enters parallel to the longitudinal direction L-L' through the second opening 48 and exits through the first opening 46.

In one embodiment, the first opening 46 faces forward and the second opening 48 faces backwards.

Preferably, the first opening 46 is oriented in the longitudinal direction L-L' in the first direction S1 and the second opening 48 is oriented in the longitudinal direction L-L' in the second direction S2.

Advantageously, the first opening 46 and the second opening 48 are arranged laterally on the same side of the component 12.

In other words, the first opening 46 and the second opening 48 are arranged in the vicinity of the same side face 40 of the component 12.

Advantageously, as illustrated in FIG. 2, the first opening 46 and the second opening 48 are arranged in the vicinity of the first side face 40 of the component 12 located in the vicinity of one of the right or left longitudinal edges 21 of the lower body 20, respectively the roof 19.

Such an arrangement of openings (first opening 46 and second opening 48) adjacent to a longitudinal edge 21 has the advantage of allowing a larger volume of air to enter than if the openings were offset towards the middle of the body 18.

Advantageously, a first grid 52 is arranged across the first opening 46.

Advantageously, a second grid 53 is also arranged across the second opening 48.

Each grid (first grid 52 or second grid 53) is configured to allow air to enter and exit through the corresponding aperture (first opening 46 or second opening 48) while filtering out impurities, such as heavy ballast and other surface debris. Such impurities could damage the component 12 and/or block the openings 46, 48.

The set of baffles 50 is configured to guide the airflow F1, F2 entering one of the first opening 46 and the second opening 48 and exiting the other through the cooling channels 44 of the component 12.

The set of baffles 50 is thus configured to deflect the airflow F1, F2 horizontally. For example, if the vehicle is travelling in the first direction S1 as shown in FIG. 2, the airflow F1 enters through the first opening 46 in the longitudinal direction L-L' and is directed backwards in the second direction S2. The set of baffles 50 deflects the airflow F1 to flow in the transverse direction T-T' through the cooling channels 44 of the component 12.

The set of baffles 50 is also configured to divert the air flow F1 exiting the cooling channels 44 in the transverse direction T-T' so that the air flow F1 can exit through the second opening 48, here in the longitudinal direction L-L'.

The set of baffles 50 comprises, for example, a first baffle 54 arranged to horizontally divert an airflow F1, F2 entering or exiting through the first opening 46 and a second baffle 56 arranged to horizontally divert an airflow F1, F2 entering or exiting through the second opening 48.

As illustrated in FIG. 2, each of the first and second baffles 54, 56 is angled, for example, in particular in the shape of a quarter circle, and extends between the first side face 40 of the component 12 and the corresponding one of the first opening 46 and the second opening 48, so as to deflect the air flow F1, F2 through an angle of 90°.

The first baffle 54 and the second baffle 56 each form a scoop to collect the air flow F1, F2 generated by the movement of the vehicle and guide it to the cooling channels 44 of the component 12.

In the embodiment of the invention illustrated in FIG. 2, the set of baffles 50 is configured such that, during movement of the vehicle 10 in the first direction S1, the airflow F1 is guided through the component 12 transversely in a first transverse direction T1 through a first group 58 of cooling channels 44, and then in a second opposite transverse direction T2 through a second group 60 of cooling channels 44. The first group 58 and the second group 60 are distinct.

Figure 3:
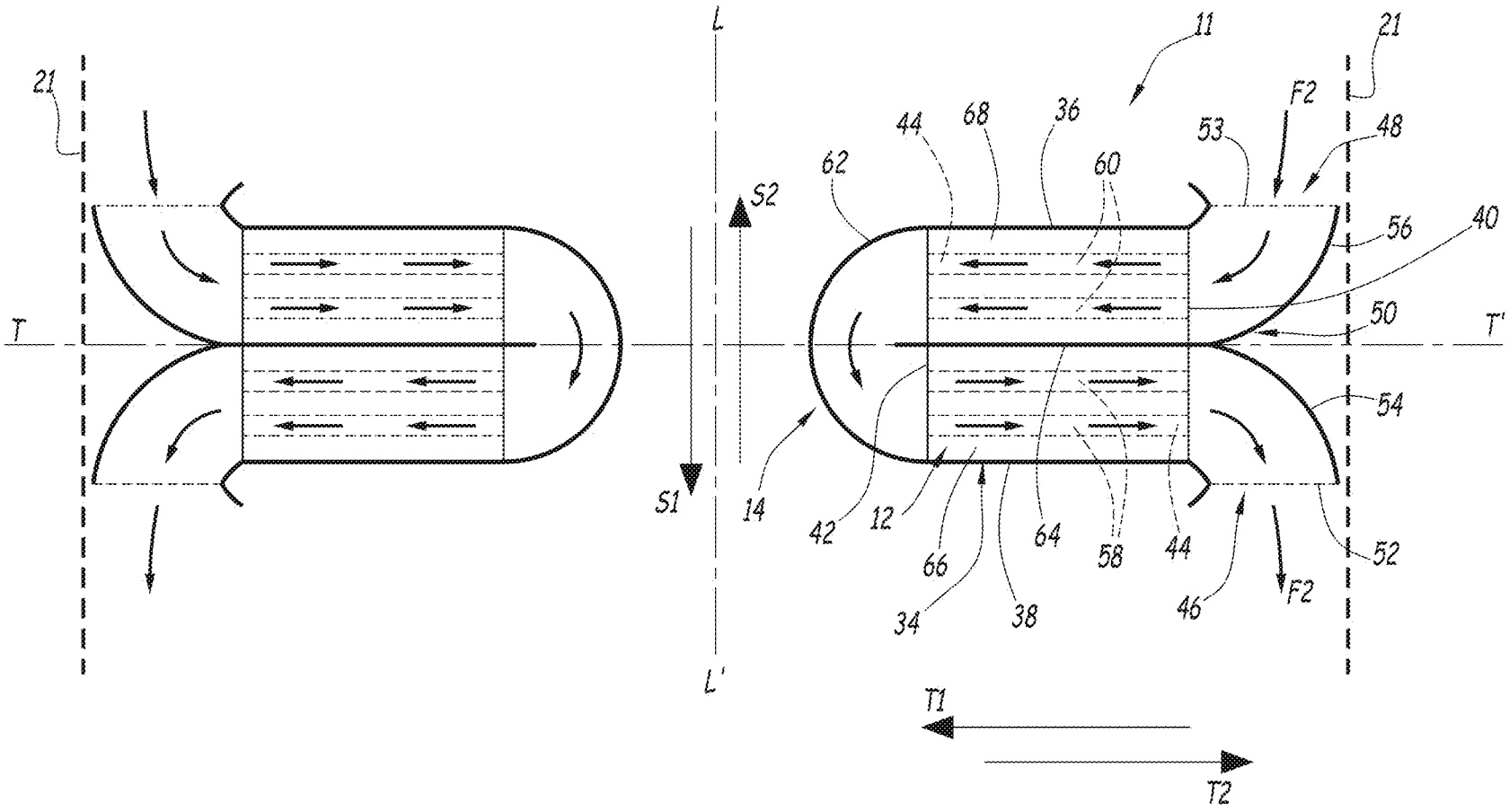
FIG. 3 is a bottom view of two cooling devices according to the invention, with the vehicle moving in a second direction opposite to the first direction.

More particularly, the first opening 46 and the second opening 48 being disposed in proximity to the first side face 40 of the component 12, the set of baffles 50 is configured to guide the airflow F1 through the component 12 in a first transverse direction T1 from the first side face 40 to the second side face 42 and then in a second opposite transverse direction T2 from the second side face 42 to the first side face 40. As illustrated in FIG. 3, in a reverse manner, during movement of the vehicle 10 in the second direction S2, the set of baffles 50 is configured to guide the airflow F2 through the component 12 transversely in the second transverse direction T2 through the second group of cooling channels 60 and then in the opposite first transverse direction T1 through the first group 58 of cooling channels 44.

The first group 58 comprises the cooling channel or channels 44 closest to the front face 38 of the component 12 and the second group 60 comprises the cooling channel or channels 44 closest to the rear face 36 of the component 12.

The set of baffles 50 comprises, for example, an intermediate baffle 62 arranged on one of the first side face 40 and the second side face 42 to guide the air flow F1 exiting the cooling channels 44 of the first group 58 to the cooling channels 44 of the second group 60, or vice versa.

In particular, the intermediate baffle 62 is arranged on the second side face 42 in order, during the movement of the vehicle 10 in the first direction S1, to guide the air flow F1 exiting from the cooling channels 44 of the first group 58 towards the cooling ducts 44 of the second group 60 and in order, during the movement of the vehicle 10 in the second direction S2, to guide the air flow F2 exiting from the cooling ducts 44 of the second group 60 towards the cooling channels 44 of the first group 58. The intermediate baffle 62 is configured to deflect the air flow F1, F2 horizontally by making a half turn, i.e. to deflect the air flow horizontally by 180°.

The intermediate baffle 62 is for example semicircular in shape and is arranged on the second side face 42 to collect air from the cooling channels 44 of the first group 58 and guide it to the cooling channels 44 of the second group 60, or vice versa.

Advantageously, the set of baffles 50 further comprises an inner baffle 64 arranged within the component 12 to prevent a flow of air F1, F2 longitudinally through the component 12.

The cooling channels 44 of the first group 58 are located in a first region 66 of the component 12 adjacent to the front face 38, and the cooling channels 44 of the second group 60 are located in a second region 68 of the component 12 adjacent to the rear face 36 of the component 12.

The inner baffle 64 advantageously extends perpendicularly to the longitudinal direction L-L' and prevents a flow of the air stream F1, F2 inside the component 12 between the first region 66 and the second region 68 of the component 12.

As illustrated in FIG. 2, the inner baffle 64 extends between the first side face 40 and the second side face 42 of the component 12 and divides the component 12 between the first region 66 and the second region 68.

The inner baffle 64 is, for example, a plate disposed within the component 12 and forming a transverse barrier between the first front region 66 and the second rear region 68 of the component 12.

At least one cooling channel 44 is arranged in the first region 66 and at least one cooling channel 44 is arranged in the second region 68.

As shown in FIG. 2, the cooling channels 44 of the first group 58 are arranged in the first front region 66 and the cooling channels 44 of the second group 60 are arranged in the second rear region 68.

A method of cooling the component 12 with the aid of the cooling device 14 will now be described in the case where the vehicle 10 is moving in the longitudinal direction L-L' in the first direction S1 forward, with reference to FIG. 2.

The movement of the vehicle 10 in the longitudinal direction L-L' in the first direction S1 generates an air flow F1 in the longitudinal direction L-L' in the second direction S2 towards the rear.

The airflow F1 enters through the first opening 46.

Advantageously, impurities, such as ballast spatter and other surface debris, potentially present in the air are filtered out by the first grid 52 as the air passes through the first opening 46.

The first baffle 54 then deflects the airflow F1 horizontally, and more specifically through an angle of 90°.

The air flow F1 is thus oriented in the transverse direction T-T' perpendicular to the longitudinal direction L-L' and enters the cooling channel(s) 44 of the first group 58 through the first side face 40 of the component 12.

The air flow F1 passes through the cooling channel(s) 44 of the first group 58 in the first transverse direction T1 from the first side face 40 to the second side face 42 of the component 12.

Such passage of the airflow F1 through the cooling channel(s) 44 of the first group 58 cools the interior of the component 12, and in particular the first front region 66 of the component 12.

The air flow F1 then exits the cooling channels 44 of the first group 58 through the second side face 42 of the component 12.

The airflow F1 is then deflected by the intermediate baffle 62, in particular by an angle of 180°.

The air flow F1 thus diverted then enters the cooling channels 44 of the second group 60 through the second side face 42 of the component 12.

The air flow F1 passes through the cooling channels 44 of the second group 60 in the second transverse direction T2 from the second side face 42 to the first side face 40 of the component 12.

Such passage of the air flow F1 through the cooling channels 44 of the second group 60 cools the interior of the component 12, and more particularly the second rear region 68 of the component 12.

The air flow F1 then exits the cooling channels 44 of the second group 60 through the first side face 40 of the component 12.

The air flow F1 is then deflected by the second baffle 56, in particular by an angle of 90°.

The air flow F1 thus diverted exits through the second opening 48.

As the vehicle moves in the first direction S1, the airflow F1 thus flows from the first opening 46 to the second opening 48.

The component 12 is thus continuously cooled by the air flow F1 generated by the movement of the vehicle 10 and guided by the cooling device 14.

As illustrated in FIG. 3, in the case where the vehicle 10 moves in the longitudinal direction L-L' in the second direction S2 towards the rear, the method of cooling the component 12 with the cooling device 14 is identical. The airflow F2 flows in the opposite direction inside the module 11.

As the vehicle moves in the second direction S2 towards the rear, the airflow F2 flows from the second opening 48 to the first opening 46.

Such a cooling device 14 allows efficient cooling of the component 12.

Guiding the air flow F1, F2 through the set of baffles 50 ensures that the component 12 is reliably cooled and is not susceptible to air turbulence.

In addition, the use of the air flow F1, F2 generated by the movement of the vehicle 10 allows the component 12 to be cooled passively, and therefore economically and without energy impact. The air passing through the component 12 is circulated solely by the movement of the vehicle 10.

In addition, the arrangement of the openings 46, 48 in the vicinity of the edges 21 of the lower body 20, respectively the roof 19, ensures that a sufficiently large volume of air is drawn in.

Furthermore, the passage of the air flow F1, F2 in the cooling channels 44 divided into a first region 66 and a second region 68 ensures a homogeneous cooling of the component 12.

In a non-illustrated embodiment, the first opening 46 and the second opening 48 are arranged adjacent to different side faces 40, 42 of the component 12.

If the module 11 is, for example, large and occupies the entire width of the lower body 20 or the roof 19, the two side faces 40, 42 are in the vicinity of one of the longitudinal edges 21 of the lower body 20 or the roof 19 respectively. The two openings 46, 48 are therefore close to the exterior of the vehicle 10 and are therefore able to draw in sufficient air volume to cool the component 12.

Furthermore, in the case where the cooling device 14 is fitted to a road vehicle 10. Symmetrical operation of the cooling device 14 is not necessary.

What is claimed is:

1. A module comprising:

a component comprising:

a first side face;

a second side face opposite the first side face; and cooling channels passing through the component between the first side face and the second side face; and a cooling device for the component, wherein the module is configured to be fitted to a vehicle configured to move in a longitudinal direction, and wherein the cooling device comprising a first opening, a second opening, and a set of baffles configured such that movement of the vehicle in the longitudinal direction generates a flow of air entering through one of the first opening or the second opening and exiting through the other, the set of baffles being configured to guide the air flow by passing it through the cooling channels of the component, and the first opening and the second opening being arranged laterally on the same side of the component.

2. The module according to claim 1, wherein the set of baffles is configured to guide the air flow through the component transversely in a first transverse direction through a first group of cooling channels and then in a second opposite transverse direction through a second group of cooling channels or vice versa.

3. The module according to claim 2, wherein the set of baffles comprises an intermediate baffle arranged on one of the first side face or the second side face of the component to guide the air flow exiting from the cooling channels of the first group towards the channels of the second group or vice versa.

4. The module according to claim 1, wherein the cooling device comprises an inner baffle arranged within the component to prevent airflow longitudinally through the component.

5. The module of claim 4, wherein the inner baffle extends between the first side face and the second side face of the component and divides the component between a first region and a second region.

6. The module according to claim 5, wherein at least one cooling channel is arranged in the first region and at least one cooling channel is arranged in the second region.

7. The module according to claim 1, wherein the cooling device comprises a first grid disposed across the first opening and/or a second grid disposed across the second opening.

8. The module according to claim 1, wherein the module is configured such that when the vehicle moves in a first direction, the air flow flows from the first opening to the second opening, and when the vehicle moves in a second direction opposite to the first direction, the air flow flows from the second opening to the first opening.

9. A vehicle configured to move in a longitudinal direction, the vehicle comprising a module according to claim 1.

10. The vehicle according to claim 9, wherein the vehicle is a railway vehicle.

11. The module according to claim 2, wherein the set of baffles is configured to guide the air flow through the component transversely in the first transverse direction between the first side face and the second side face through the first group of cooling channels and then in the second opposite transverse direction between the first side face and the second side face through the second group of cooling channels or vice versa.

12. The module according to claim 3, wherein the intermediate baffle is positioned outside of the component on one of the first side face or the second side face of the component.

* * * * *